United States Patent [19]

Yamauchi

[11] 4,151,522

[45] Apr. 24, 1979

[54] COUNT DISCRIMINATING FIRE DETECTION SYSTEM

[75] Inventor: Yukio Yamauchi, Kawasaki, Japan

[73] Assignee: Hochiki Corporation, Japan

[21] Appl. No.: 806,881

[22] Filed: Jun. 15, 1977

[30] Foreign Application Priority Data

Jun. 17, 1976 [JP] Japan ..... 51-70410

[51] Int. Cl.[2] ..... G08B 17/00

[52] U.S. Cl. ..... 340/587; 340/309.1; 340/628

[58] Field of Search ..... 340/227 R, 228 R, 237 S, 340/309.1, 584, 587, 593, 595, 628, 629, 630

[56] References Cited

U.S. PATENT DOCUMENTS 3,621,262 11/1971 Lecuyer ..... 340/228 R 4,065,758 12/1977 Barbier et al. ..... 340/227 R

*Primary Examiner*—Glen R. Swann, III

*Attorney, Agent, or Firm*—Wenderoth, Lind & Ponack

[57] ABSTRACT

A fire detector senses the change in a physical parameter indicative of a fire such as smoke, heat or the like and produces detection pulses in synchronism with an oscillator circuit when the change in the physical parameter exceeds a predetermined amount. A counting means counts the detection pulses and produces an output which triggers an alarm circuit when a predetermined number of consecutive detection pulses are counted. The count of the counting means is reset by a reset means whenever the detection pulses are nonconsecutive, that is, whenever an oscillator pulse is received without receipt of a corresponding detection pulse. By this means intermittent changes in the physical parameter which indicate some false alarm signal rather than a real fire do not produce the required number of consecutive detection pulses and do not set off the alarm circuit. On the other hand when a real fire occurs the circuit always counts detection pulses from the beginning of the detection of a fire because the counting means is reset each time a series of consecutive detection pulses less than the predetermined number ends.

5 Claims, 6 Drawing Figures

COUNT DISCRIMINATING FIRE DETECTION SYSTEM

BACKGROUND OF THE INVENTION

The present invention relates to a count discriminating fire detection system in which a predetermined number of pulses obtained from the output of a fire sensor are counted to issue an alarm, and more particularly to a system including counting means which is reset whenever a series of consecutive detection pulses less than the predetermined number ends.

A type of prior count discriminating fire detection system uses a capacitor which is charged to a predetermined voltage by applying the detection output or the pulses produced by a fire sensor to energize an alarm circuit. However, various disturbance signals or outputs which may be produced from a fire sensor when false alarm triggers arise such as smoking, the burning of small pieces of paper, steaming and so on also charge the capacitor. Therefore, this capacitor should be periodically discharged. Complex circuitry is required to periodically discharge the voltage stored in the capacitor thus employed.

Another type of such a system is disclosed in U.S. Pat. No. 3,842,409, which uses a shift registor and a capacitor in combination. A control circuit is connected between this capacitor (which is also connected to a data terminal of the shift registor) and an output terminal of the fire sensor to repetitively charge and discharge the capacitor, so that the shift registor may be reset by a clock pulse upon disappearance of the data signal at the data terminal in response to the discharge period of the capacitor. This system should be improved because of its complexity.

SUMMARY OF THE INVENTION

It is an object of the present invention to provide a storage fire detection system comprising counting means and reset means in which the counting means can be reset by the reset means upon discontinuance of continuous detection pulses from a fire sensor at a number smaller than a predetermined number.

It is another object of the invention to provide a storage fire detection system in which detection pulses applied to the counting means are substantially synchronized with oscillating pulses which reset the counting means.

Still another object of the present invention is to provide a storage fire detection system in which the counting means repeats its counting operation without time loss after the detection pulses applied to the counting means discontinue.

Distinction between a real fire and above-mentioned false alarm triggers which frequently arise is effectively made in a statistical manner in that discontinous pulses will ordinarily correspond to false alarms and continuous pulses to a real fire. Such pulses are obtained from or produced from the output of a fire sensor, which correspond to physical changes of more than a predetermined amount in the monitored parameter such as smoke, heat and the like. Especially, fire sensors which operate with pulse energy can directly produce output pulses suitable for this purpose. Moreover, continous pulses of from 3 to 12 in number having pulse intervals 2 sec. to 5 sec. may reliably distinguish the detection of a fire from various false alarms. The preferred combination of the number of continuous pulses and the pulse intervals is selectively set in accordance with the location of the respective fire sensors and the possible kinds of fires, for example, oil, gas, other ordinary fires and the like.

The system according to the invention can reset the counting means when the pulses applied thereto become discontinuous. Moreover, after a particular counting operation of the counting means is stopped and reset by a reset pulse, successive counting operations start without loss of any pulse supplied from the fire sensor so that all of the pulses are applied to and counted by the counting means.

In the initial stages of a fire during which discontinuous pulses are produced, the counting means in repetitively reset and counts the pulse or pulses every time the pulses discontinue, and the counting operation repeats until the predetermined number of continuous pulses are produced and applied thereto. Thus, the predetermined number of continuous pulses which are produced for the first time when a fire arises can be counted by the counting means without loss of any pulses thereby to issue an alarm.

Further, the system uses a common oscillator circuit to produce or form the pulses for applying to the counting means and to make the reset pulse for applying to the counting means, so that the two different pulses can be substantially synchronized each other. Although this method causes a time difference between the two pulses, it is too small to affect the operation of this system.

BRIEF DESCRIPTION OF THE DRAWINGS

Other features and advantages of the storage fire detection system according to the invention will be apparent from the disclosure and appended claims and drawings in which:

DESCRIPTION OF THE PREFERRED EMBODIMENT

Figure 1:
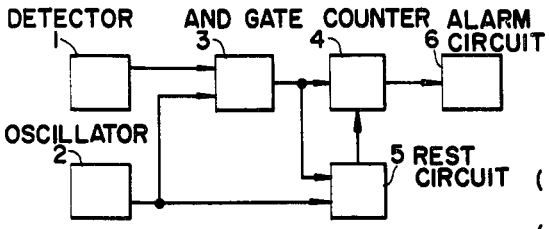
FIG. 1 is a block diagram of the storage fire detection system using a d.c. output type fire sensor according to the invention.

The storage fire detection system according to the invention illustrated in FIG. 1 includes a fire detector 1 which produces a d.c. output when it detects a physical change more than a predetermined amount. This detector has an amplifying transistor such as a field effect transistor connected to an output terminal of a fire sensor such as an ionization smoke sensor. An oscillation circuit 2 produces pulses at a constant frequency having a pulse interval suitable for detection of the physical changes of a fire according to the particular type of sensor. An AND gate 3 has two input terminals connected to an output terminal of the fire detector 1 and the oscillator circuit 2, respectively and the d.c. output of the fire detector 1 is converted into corresponding detection pulses "b" by the oscillating pulses "a" according to the logical product of the AND gate 3. The detection pulses "b" are applied to a counting means 4. Furthermore, a reset circuit 5 is used which has two input terminals connected to the oscillator circuit 2 and to the output terminal of the AND gate 3, respectively. This reset circuit 5 can not produce a reset pulse when both detection pulse "b" and oscillating pulse "a" are applied concurrently thereto, but can produce and apply a reset pulse "c" to the reset terminal of the counting means 4 when no detection pulse "b" is applied to the reset circuit 5 despite the application of a pulse "a". The counting means 4 can be reset whenever no detection pulse "b" is applied to the reset circuit 5.

Figure 2:
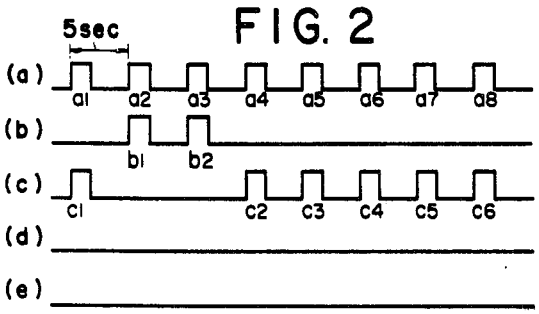
FIG. 2 is a time chart illustrating the operation of the system upon sensing a false alarm.

The counting means can produce an output "d" effective to energize an alarm circuit 6 after it has counted a predetermined number of continuous detection pulses "b". This number is selectively predetermined as mentioned above, for example, as four in the respective time charts illustrated in FIGS. 2, 3 and 4. In FIG. 2 the reset circuit 5 generates the reset pulse "c2" and applies it to the counting means 4 when the oscillating pulse "a4" enters the reset circuit 5, because only two continuous detection pulses "b1" and "b2" enter the counting means but no detection pulses are produced thereafter. While no detection pulse "b" is applied to both the counting means 4 and the reset circuit 5, the oscillating pulses "a4", "a5" and etc. which are applied only to the reset circuit 5 continue to reset the counting means 4. This example will correspond to false alarm triggers such as smoking, the burning of small pieces of paper and etc., since the number of continuous detection pulses "b" is less than the predetermined number, that is, the physical change detected by the fire sensor is intermittent and only exceeds the predetermined amount thereof for a relatively short time.

Figure 3:
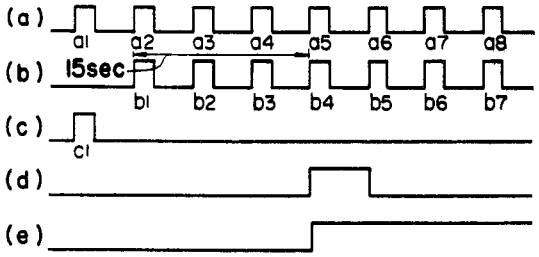
FIG. 3 is a time chart illustrating the operation of the system upon detecting a real fire.
Figure 4:
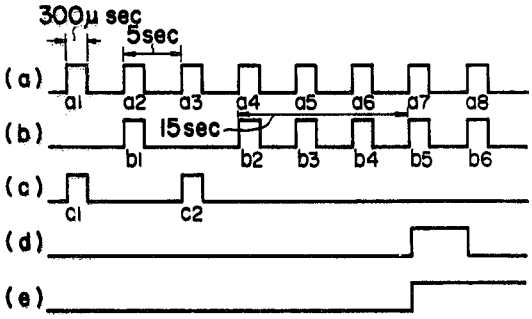
FIG. 4 is a time chart illustrating the operation of the system after the counting means is reset by a discountinuous pulse.

When a real fire arises, continuous detection pulses "b1", "b2", "b3" and "b4" are successively counted by the counting means as illustrated in FIG. 3. After counting up to the predetermined number this counting means 4 produces an output "d" to energize the alarm circuit 6 for developing an alarm current "e". The time chart in FIG. 4 illustrates that after a discontinuous pulse "b1" due to a disturbance signal or a small fire which is not yet identified as a real fire or a false alarm has been produced and counted by the counting means 4, the counting means 4 is reset by the reset pulse "C2". Immediately the counting means 4 begins to count a first detection pulse "b2" of a continuous set of detection pulses "b2", "b3", "b4" and "b5" thereby to produce the output "d". Thus, even if randomly discontinuous pulses "b" are applied to the counting means 4, the counting operation of this counting means does not delay nor miss any first detection pulse "b" of continuous sets of pulses.

Figure 5:
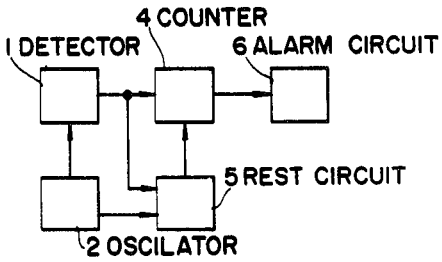
FIG. 5 is a block diagram of another storage fire detection system according to the invention.

The system illustrated in FIG. 5 uses a fire detector 1 which operates with pulse energy. This pulse source uses the oscillator circuit 2 so that the detection pulse output "b" of this fire detector is substantially synchronous with the oscillating pulse "a". Although time differences do occur between the detection pulse output "b" and the oscillating pulse "a", they are negligible or easily controlled.

Figure 6:
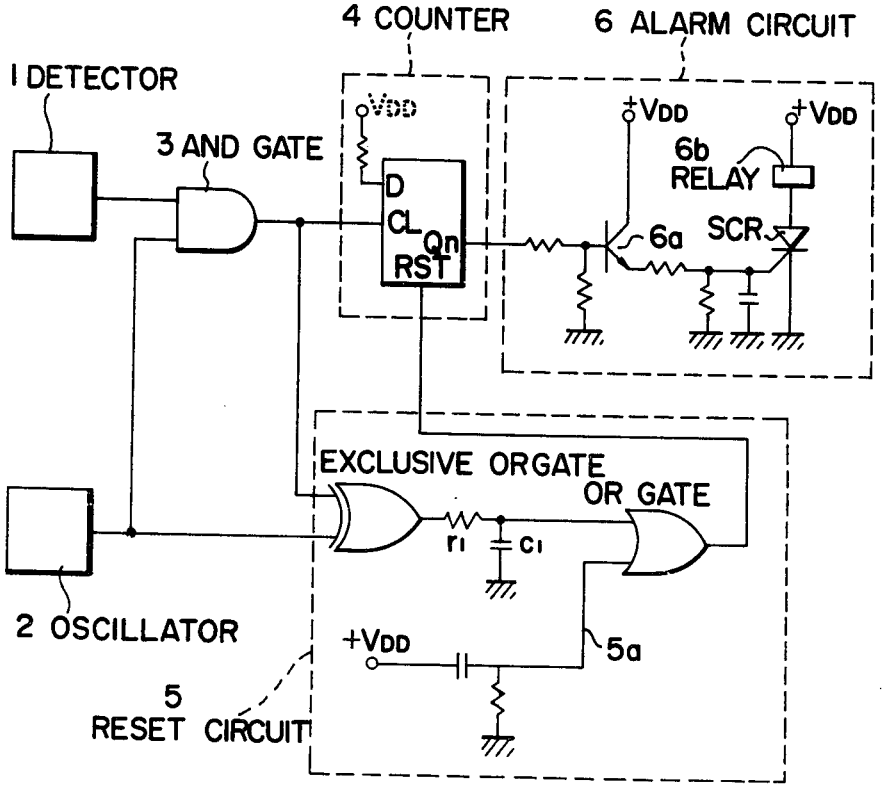
FIG. 6 is an embodiment of the storage fire detection system using a counter or a shift registor and an exclusive-OR gate in combination according to the invention.

The storage fire detection system according to the invention illustrated in FIG. 6 uses a counter or a shift registor as the counting means 4 and also an exclusive-OR gate as part of the reset circuit 5. The input-output relation of the exclusive-OR gate is as follows:

| P | Q | R |
|---|---|---|
| 0 | 0 | 0 |
| 0 | 1 | 1 |
| 1 | 1 | 0 |
| 1 | 0 | 1 |

wherein P is the output of the AND gate 3 or the detection pulse "b"; Q is the pulse "a" of the oscillator circuit 2; and R is the output of the exclusive-OR gate. Since this exclusive-OR gate always receives the oscillating pulse "a" as the input Q, this gate produces the reset pulse "c" whenever the detection pulse "b" discontinues according to the logical truth table.

A delay circuit comprising a resistor r1 and a capacitor c1 is connected to an output terminal of the exclusive-OR gate, and this delay circuit can absorb the output that would be accidentally developed due to little time difference between the pulse "a" and the pulse "b". An OR gate is connected to the output terminal of this delay circuit, and the remaining input terminal of the OR gate is connected to an auxiliary reset circuit for resetting the system when first turned on. In this arrangement, the reset terminal RST of the counting means 4 is connected to the output terminal of the OR gate.

The counter receives the detection pulses "b" on its clock input terminal CL, and an output terminal $Q_n$ thereof is connected to the alarm circuit 6. A shift register is used as the counting means and a power source $V_{DD}$ is connected to a data terminal D of the shift register. The alarm circuit 6 is comprised of a transistor 6a for amplifying the output of the counter or the shift register 4, a thyristor SCR having a gate connected to an output terminal of the transistor 6a and a relay 6b connected in series with the thyristor SCR. When the thyristor SCR conducts the relay is energized to actuate various devices.

What is claimed is:

1. A count discriminating fire detection system comprising, in combination;

an oscillator circuit for generating oscillating pulses at a predetermined frequency;

a fire detection means connected to said oscillator circuit for detecting a change of more than a predetermined amount in a physical parameter indicative of a fire for producing detection pulses synchronous with said oscillating pulses;

a counting means having an input terminal connected to said fire detection means and a reset terminal, for counting said detection pulses for producing an output upon counting a predetermined number said detection pulses and for resetting said counting upon application of a signal to said reset terminal;

a reset means having a first input terminal connected to said fire detection means, a second input terminal connected to said oscillator circuit and an output terminal connected to said reset terminal of said counting means, for applying a signal to said reset terminal of said counting means upon receiving an oscillator pulse without receiving a detection pulse; and an alarm circuit connected to said counting means for producing a fire alarm when said counting means produces an output.

2. A fire detection system according to claim 1, wherein said fire detection means comprises:

a fire sensor for detecting a change of more than a predetermined amount in a physical parameter indicative of a fire for producing a d.c. output; and an AND gate having a first input connected to said oscillator circuit and a second input connected to said fire sensor for converting said d.c. output of said fire sensor into detection pulses.

3. A fire detection system according to claim 1, wherein said reset means comprises an exclusive-OR gate and wherein said counting means comprises a resettable counter.

4. A fire detection system according to claim 3 wherein said reset means further comprises a delay circuit connected to the output of said exclusive-OR gate for absorbing an output of said exclusive-OR gate due to small time differences between said oscillating pulses and said detection pulses.

5. A fire detection system according to claim 3 wherein said resettable counter comprises a fixed voltage source and a shift register having a data terminal connected to said fixed voltage source and a clock input terminal connected to the output of said fire detection means.

* * * * *